US010557304B2

(12) United States Patent
Anderson et al.

(10) Patent No.: US 10,557,304 B2
(45) **Date of Patent: *Feb. 11, 2020**

(54) ARRANGEMENT FOR MOUNTING AN ACTUATOR BUTTON ONTO A RAIL OF A WINDOW COVERING

(71) Applicant: Hunter Douglas, Inc., Pearl River, NY (US)

(72) Inventors: Richard N. Anderson, Whitesville, KY (US); Eugene W. Thompson, Maceo, KY (US); Robert E. Fisher, II, Thornton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,450

(22) Filed: Jul. 14, 2017

(65) Prior Publication Data

US 2017/0314325 A1 Nov. 2, 2017

Related U.S. Application Data

(63) Continuation of application No. 14/816,270, filed on Aug. 3, 2015, now Pat. No. 9,708,850, which is a continuation-in-part of application No. 14/326,616, filed on Jul. 9, 2014, now Pat. No. 9,422,766.

(60) Provisional application No. 61/873,035, filed on Sep. 3, 2013, provisional application No. 61/847,117, filed on Jul. 17, 2013.

(51) Int. Cl.

| | |
|---|---|
| ***E06B 9/322*** | (2006.01) |
| ***E06B 9/325*** | (2006.01) |
| ***E06B 9/324*** | (2006.01) |
| ***E06B 9/90*** | (2006.01) |
| ***E06B 9/262*** | (2006.01) |

(52) U.S. Cl.

CPC ..... *E06B 9/322* (2013.01); *E06B 9/262* (2013.01); *E06B 9/324* (2013.01); *E06B 9/325* (2013.01); *E06B 9/90* (2013.01); *E06B 2009/2625* (2013.01); *E06B 2009/2627* (2013.01); *E06B 2009/3222* (2013.01); *Y10T 16/44* (2015.01)

(58) Field of Classification Search

CPC ..... E06B 9/322; E06B 9/262; E06B 9/324; E06B 9/325; E06B 9/90; E06B 2009/2625; E06B 2009/2627; E06B 2009/3222; Y10T 16/44

USPC ..... 160/84.04, 84.05, 84.01

See application file for complete search history.

(56) References Cited

U.S. PATENT DOCUMENTS

| | | | | |
|---|---|---|---|---|
| 800,279 A | | 9/1905 | Emery | |
| 2,234,097 A | * | 3/1941 | Tinnerman | E05B 1/0015 403/257 |
| 2,239,798 A | * | 4/1941 | Tinnerman | A47B 95/00 16/422 |
| 2,329,767 A | * | 9/1943 | Jakeway | A47B 95/02 16/415 |
| 2,486,557 A | * | 11/1949 | Flora | A47B 95/02 16/413 |

(Continued)

FOREIGN PATENT DOCUMENTS

| | | |
|---|---|---|
| DE | 10216363 | 6/2003 |
| EP | 2740878 | 6/2014 |

(Continued)

*Primary Examiner* — Johnnie A. Shablack

(74) *Attorney, Agent, or Firm* — Dority & Manning, P.A.

(57) ABSTRACT

An arrangement for mounting an actuator button to a rail wherein the fastener for securing the button housing to the rail is hidden from view of the user.

30 Claims, 12 Drawing Sheets

(56) References Cited

U.S. PATENT DOCUMENTS 2,542,038 A * 2/1951 Lewis ..... B21J 15/18 16/110.1
2,608,712 A * 9/1952 Seyforth ..... E05B 1/0015 16/419
2,695,690 A * 11/1954 Rees ..... A47B 95/02 16/413
2,761,721 A * 9/1956 Jakeway ..... E05B 1/0038 16/413
2,982,989 A * 5/1961 Heyer ..... A47B 95/02 16/414
3,000,047 A * 9/1961 Hill ..... E05B 1/0015 16/414
3,007,348 A * 11/1961 Barnes ..... G05G 1/085 16/110.1
3,470,764 A * 10/1969 Frymire ..... E06B 7/084 49/87.1
3,995,349 A * 12/1976 Roberts ..... A47B 95/02 16/412
4,807,686 A * 2/1989 Schnebly ..... E06B 9/262 160/7
4,887,657 A * 12/1989 Spohr ..... E06B 9/365 160/178.1 R
4,911,348 A * 3/1990 Rasor ..... B60R 9/045 224/321
5,267,598 A * 12/1993 Marocco ..... E06B 9/307 160/176.1 R
5,405,115 A * 4/1995 Reed ..... A61G 15/16 16/422
5,647,422 A * 7/1997 Weng ..... E06B 9/364 160/176.1 V
5,927,836 A * 7/1999 Herr ..... D06F 39/12 16/412
5,957,184 A * 9/1999 Gross ..... E06B 9/322 160/177 R
6,024,154 A 2/2000 Wang et al.
6,029,734 A 2/2000 Wang et al.
6,439,626 B1 * 8/2002 Rohlfing ..... E05B 85/10 16/110.1
6,536,503 B1 3/2003 Anderson et al.
6,575,223 B1 6/2003 Chung et al.
6,644,372 B2 11/2003 Judkins
6,675,861 B2 1/2004 Palmer et al.
6,684,930 B2 2/2004 Palmer et al.
6,823,925 B2 11/2004 Militello et al.
6,932,140 B2 8/2005 Ni
7,093,644 B2 8/2006 Strand
7,096,917 B2 8/2006 Ciuca et al.
7,117,919 B2 10/2006 Judkins
7,159,635 B2 * 1/2007 Holt ..... E06B 9/322 160/170
7,175,377 B2 * 2/2007 Womack ..... B60P 7/0815 410/104
7,180,398 B2 * 2/2007 Hoffmann ..... H01F 5/02 336/198
7,311,134 B2 12/2007 Cheng
7,320,354 B2 1/2008 Cheng
7,331,370 B1 2/2008 Militello et al.
7,575,036 B2 8/2009 Cheng
7,624,893 B2 * 12/2009 Hoff ..... A47J 45/061 16/421
7,690,415 B2 4/2010 Cheng
7,740,045 B2 6/2010 Anderson et al.
7,913,738 B2 * 3/2011 Fraser ..... E06B 9/322 160/115
7,967,345 B2 * 6/2011 Davies ..... E05B 65/0876 292/336.3
D647,777 S * 11/2011 Franssen ..... D8/107
8,074,698 B2 12/2011 Allsopp
8,739,853 B2 6/2014 Judkins
8,770,257 B2 * 7/2014 Kao ..... E06B 9/322 160/174 R
8,794,296 B2 8/2014 Shih et al.
8,887,786 B2 11/2014 Anderson et al.
8,944,135 B2 * 2/2015 Spray ..... E06B 9/262 160/168.1 R
9,078,537 B2 * 7/2015 Lee ..... A47H 5/032
9,157,274 B2 10/2015 Cheng
9,217,282 B2 * 12/2015 Defenbaugh ..... E06B 9/68
9,314,125 B2 4/2016 Anthony et al.
9,341,019 B2 5/2016 Chen
9,357,868 B2 6/2016 Anderson et al.
9,422,766 B2 8/2016 Anderson et al.
9,445,684 B2 * 9/2016 Franssen ..... E06B 9/388
9,482,048 B2 * 11/2016 Anderson ..... E06B 9/262
9,677,330 B2 * 6/2017 Anderson ..... E06B 9/322
9,708,850 B2 * 7/2017 Anderson ..... E06B 9/322
10,138,674 B2 * 11/2018 Hsu ..... E06B 9/32
2002/0088562 A1 7/2002 Palmer
2005/0205219 A1 9/2005 Hsu
2006/0118248 A1 6/2006 Anderson et al.
2006/0196612 A1 9/2006 Strand et al.
2007/0023151 A1 * 2/2007 Judkins ..... E06B 9/322 160/170
2007/0051477 A1 * 3/2007 Fraser ..... E06B 9/262 160/84.05
2007/0151676 A1 * 7/2007 Lin ..... E06B 9/262 160/170
2008/0000592 A1 1/2008 Huang
2008/0115894 A1 * 5/2008 Cech ..... E06B 9/36 160/168.1 V
2008/0277075 A1 11/2008 Cheng
2008/0277076 A1 11/2008 Cheng
2010/0206492 A1 8/2010 Shevick
2011/0179603 A1 * 7/2011 Edelen ..... A47B 95/02 16/415
2011/0289730 A1 * 12/2011 Gerdes ..... E05B 81/78 16/412
2012/0227912 A1 * 9/2012 Anderson ..... E06B 9/32 160/87
2013/0032300 A1 2/2013 Yu et al.
2013/0340949 A1 * 12/2013 Anderson ..... E06B 9/262 160/84.02
2014/0048220 A1 2/2014 Cheng
2014/0076504 A1 * 3/2014 Anthony ..... A47H 5/032 160/84.04
2014/0158314 A1 6/2014 Anderson et al.
2015/0013921 A1 1/2015 Franssen
2015/0020982 A1 1/2015 Anderson et al.
2015/0028144 A1 * 1/2015 Defenbaugh ..... E06B 9/322 242/378.4
2015/0075729 A1 * 3/2015 Anderson ..... E06B 9/262 160/193
2015/0197984 A1 * 7/2015 Anderson ..... E06B 9/322 160/298
2015/0211293 A1 * 7/2015 Anderson ..... E06B 9/262 160/170
2016/0010389 A1 * 1/2016 Anderson ..... E06B 9/322 188/65.1
2016/0017656 A1 * 1/2016 Adreon ..... E06B 9/322 160/7
2016/0222722 A1 * 8/2016 Schulman ..... E06B 9/322
2016/0251896 A1 9/2016 Anderson et al.
2016/0319594 A1 * 11/2016 Anderson ..... E06B 9/324
2017/0044822 A1 * 2/2017 Anderson ..... E06B 9/262
2017/0218695 A1 * 8/2017 Hsu ..... E06B 9/32
2017/0226794 A1 * 8/2017 Huang ..... E06B 9/322
2017/0234063 A1 * 8/2017 Schwandt ..... E06B 9/32 160/368.1
2017/0314325 A1 * 11/2017 Anderson ..... E06B 9/322

FOREIGN PATENT DOCUMENTS

EP 2826944 1/2015
WO WO 2012/154871 11/2012
WO WO-2012154871 A1 * 11/2012 ..... A47H 5/032
WO WO 2013/129918 9/2013

* cited by examiner

ARRANGEMENT FOR MOUNTING AN ACTUATOR BUTTON ONTO A RAIL OF A WINDOW COVERING

This application is a continuation of patent application Ser. No. 14/816,270, filed Aug. 3, 2015, which is a continuation-in-part of U.S. patent application Ser. No. 14/326,616, filed Jul. 9, 2014, which, in turn, claims priority to U.S. application Ser. No. 61/873,035 filed Sep. 3, 2013 and from U.S. application Ser. No. 61/847,117 filed Jul. 17, 2013, the disclosures of all of which are hereby incorporated herein by reference in their entirety for all purposes.

BACKGROUND

The present invention relates to an arrangement for mounting an actuator button onto a rail of a window covering.

SUMMARY

The present invention provides a simple, secure, inexpensive arrangement for securing an actuator button onto a rail of a window covering wherein the fasteners that secure the button housing onto the rail are concealed by the actuator button.

DESCRIPTION

Figure 1:
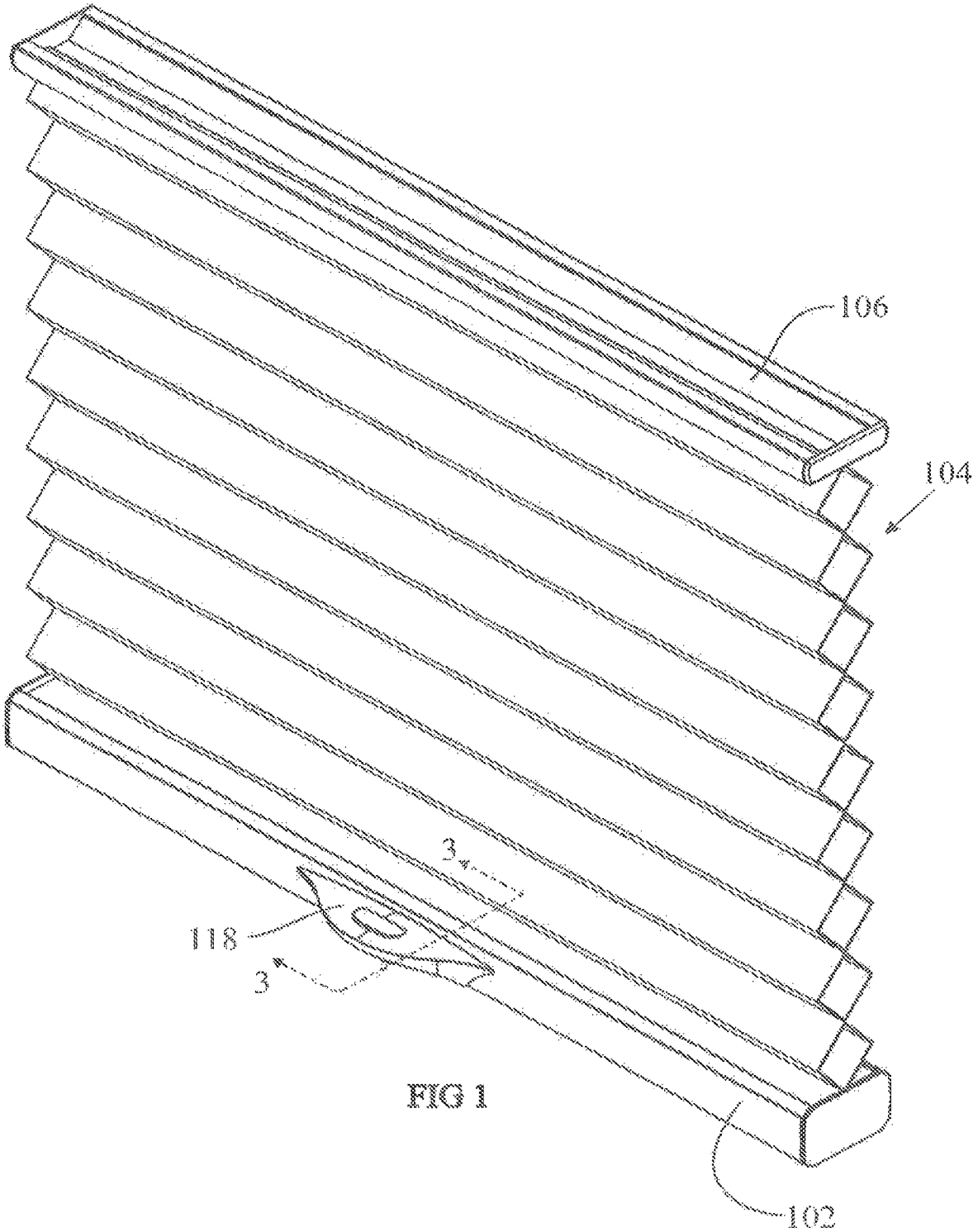
FIG. 1 is a perspective view of a cellular shade product with a handle secured to the movable ran.

FIG. 1 is a perspective view of a cellular shade 104, having an upper rail 106, a movable lower rail 102, and a handle 118 mounted on the lower rail 102. As will be explained later, the handle 118 also may be mounted on the upper rail 106 or on any intermediate movable rails (not shown).

Figure 2:
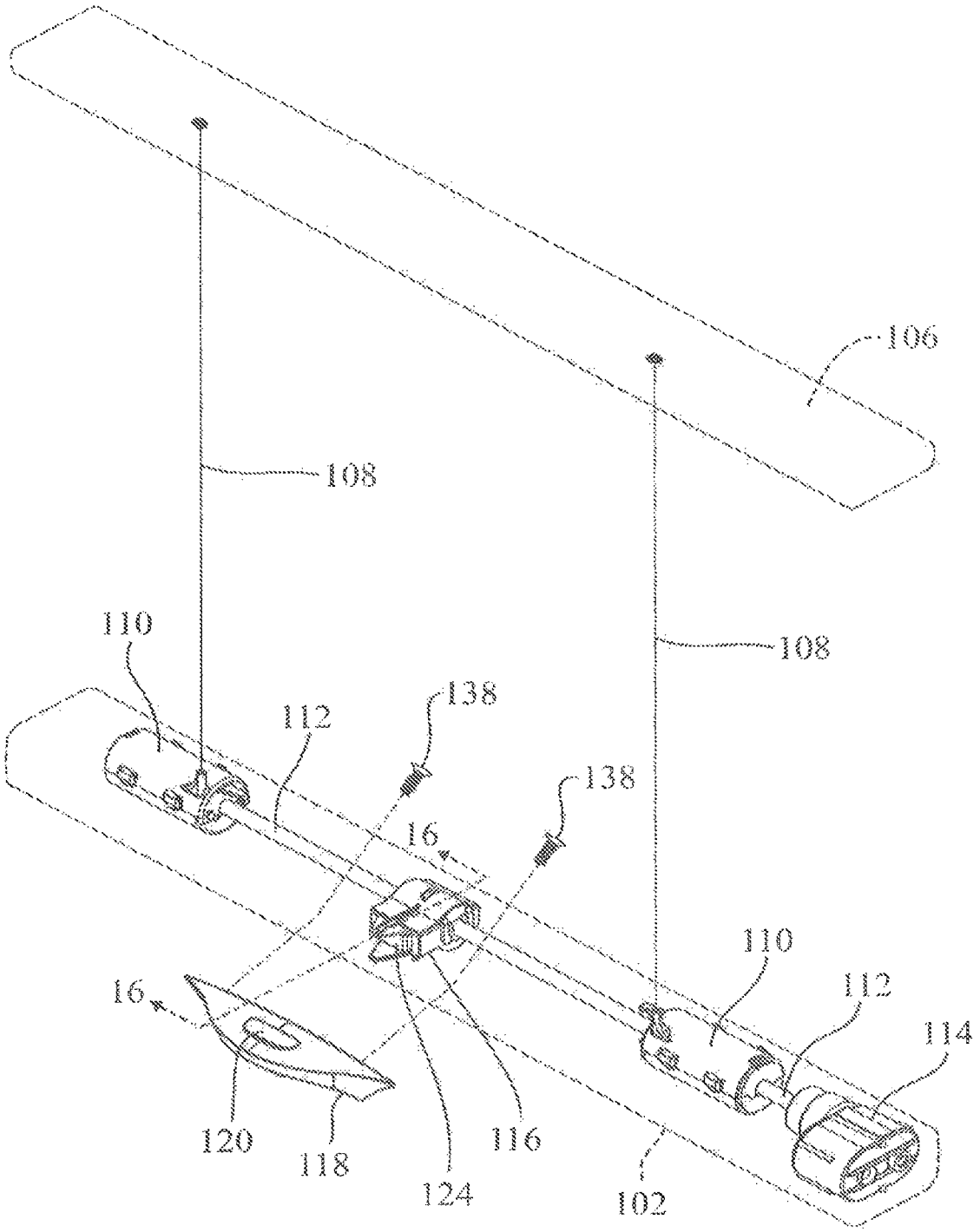
FIG. 2 is a schematic, partially exploded, perspective view of the drive mechanism of FIG. 1 including the handle and a brake.
Figure 3:
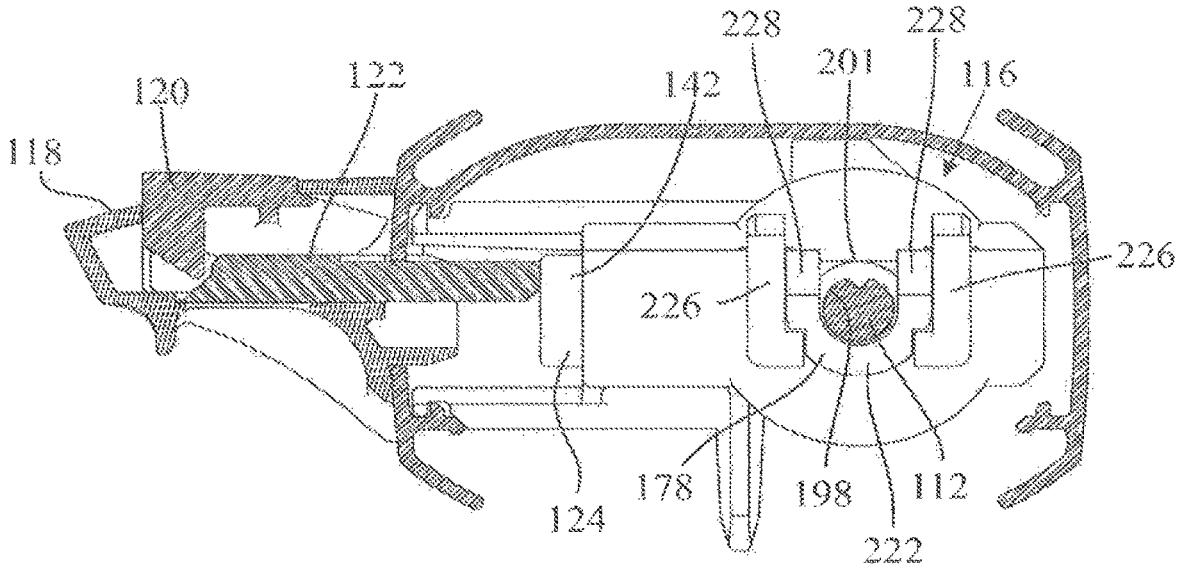
FIG. 3 is a section view along line 3-3 of FIG. 1, with the cellular shade product omitted for clarity.
Figure 4:
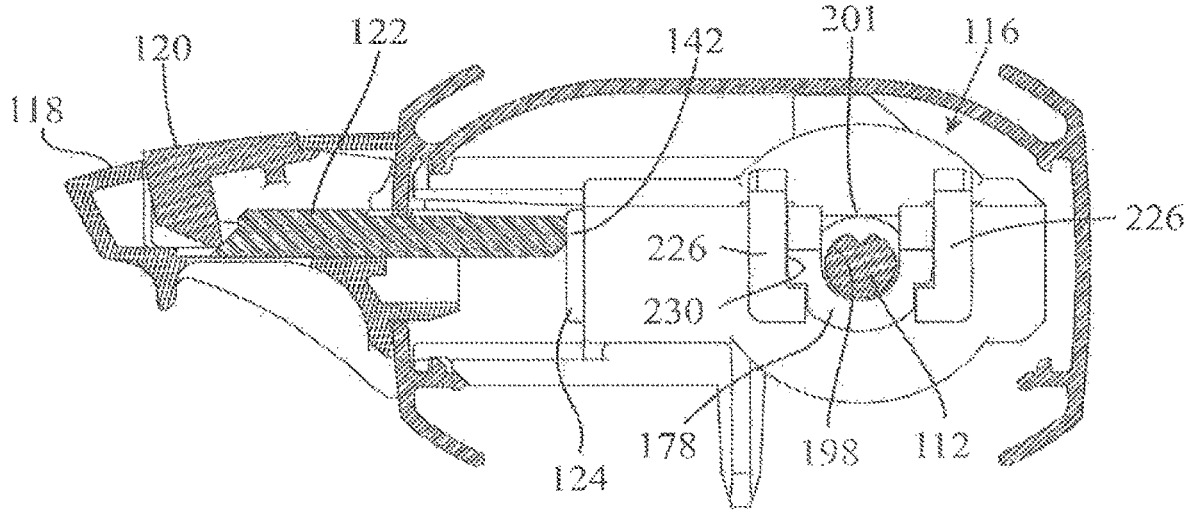
FIG. 4 is a section view, similar to FIG. 3, but with the brake release mechanism depressed to release the brake.

FIG. 2 is a schematic showing the rails 102, 106 in phantom, with the cellular shade itself omitted for clarity. The lower rail 102 is suspended from the upper rail 106 by means of left and right lift cords 108 which wind onto lift spools (not shown) in lift stations 110 (when raising the shade 104), or unwind from the spools of the lift stations 110 (when lowering the shade 104). The lift stations 110 are functionally interconnected by an elongated lift rod 112 that extends in the elongated direction of the rail, such that the lift rod 112 and lift spools of the lift stations 110 rotate in unison. The lift rod 112 extends through the rightmost lift station 110 and is connected to a spring motor 114 which provides a force to aid the user in lifting the shade 104. As the rod 112 rotates in one direction about its axis of rotation, the lift cords 108 wind up onto the lift spools of the lift stations 110 to retract the shade, and as the rod 112 rotates in the opposite direction, the lift cords 108 unwind from the lift spools and extend the shade or covering 104.

In this embodiment, the spring motor 114 is underpowered such that it is unable to raise the shade 104 alone and needs additional input from the user to accomplish that task. This particular spring motor 114 also is unable to hold the bottom rail 102 in place once it is released by the user. The weight of the bottom rail 102, together with the components found in the bottom rail 102 and the weight of the shade material, overwhelms the force provided by the spring motor 114 such that the bottom rail 102 will continue to drop once released by the user unless it is stopped by other means. To stop the bottom rail from dropping, a brake 116 is functionally connected to the lift rod 112 and to the bottom rail 102 to stop the lift rod 112 from rotating in at least one direction relative to the bottom rail 102, as explained in more detail later.

The handle 118 includes an actuator button 120 which, when depressed by the user, releases the brake 116, which allows rotation of the lift rod 112 in both clockwise and counterclockwise directions, as explained in more detail later. The handle 118 is secured to the rail 102 using screws 138, which are concealed from view from the exterior of the rail 102 by the handle 118.

The brake 116 can be mounted anywhere along the lift rod 112 and does not have to be precisely located relative to the handle 118 in order for the actuator button 120 to function to release the brake 116. This is advantageous, as it permits the handle to be secured to the rail 102 from inside the rail with the brake 116 out of the way, and then permits the brake 116 to be slid along the lift rod 112 into a position that is generally opposite the handle 118, without having to worry about the precise location of the brake 116.

Figure 5:
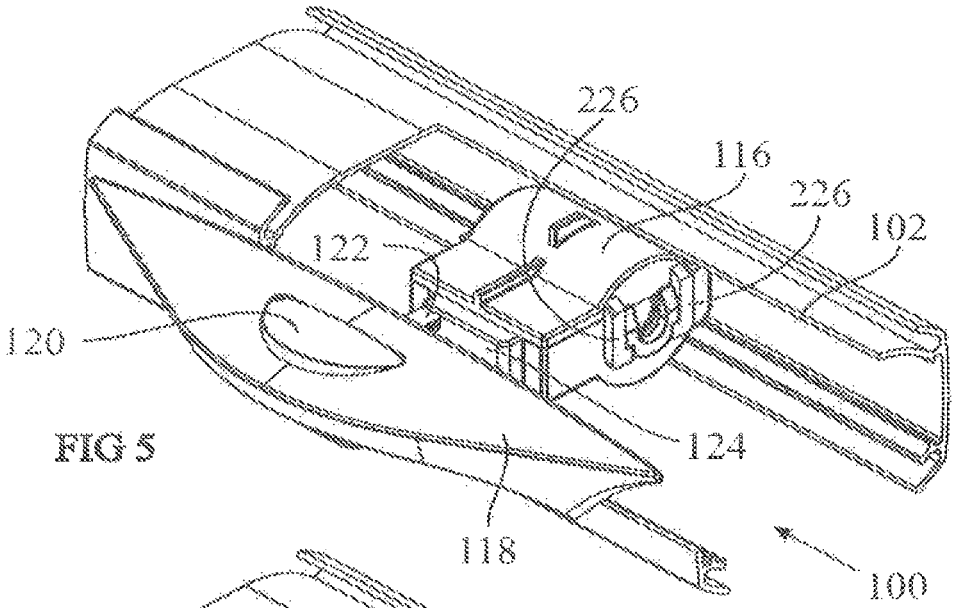
FIGS. 5-7 show the handle and brake mechanism of FIG. 3 with the lift rod omitted for clarity, and with the brake portion in three different axial positions relative to the handle portion to illustrate that the brake portion does not have to be precisely located in order for the pusher to actuate the brake release mechanism.
Figure 6:
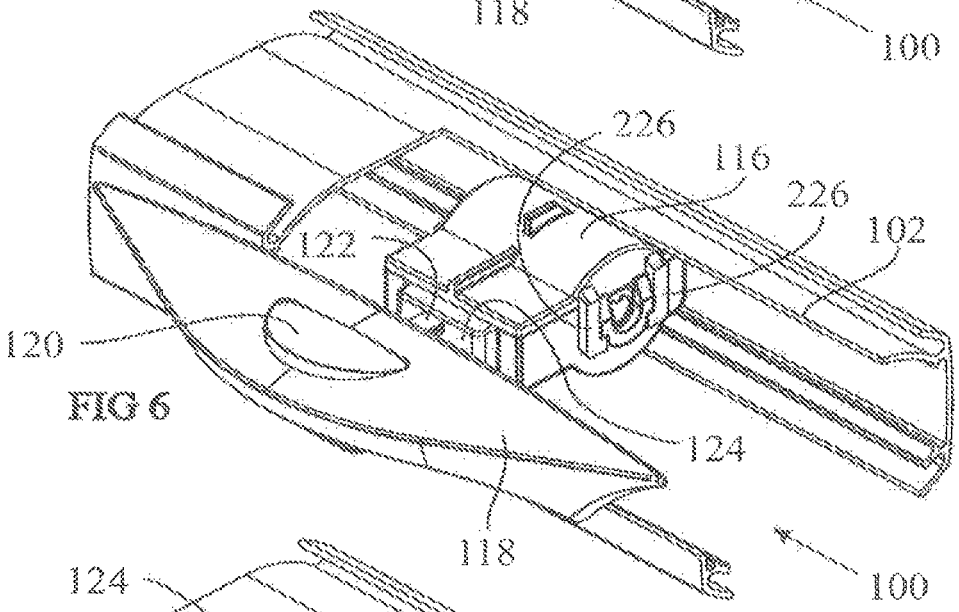
Figure 7:
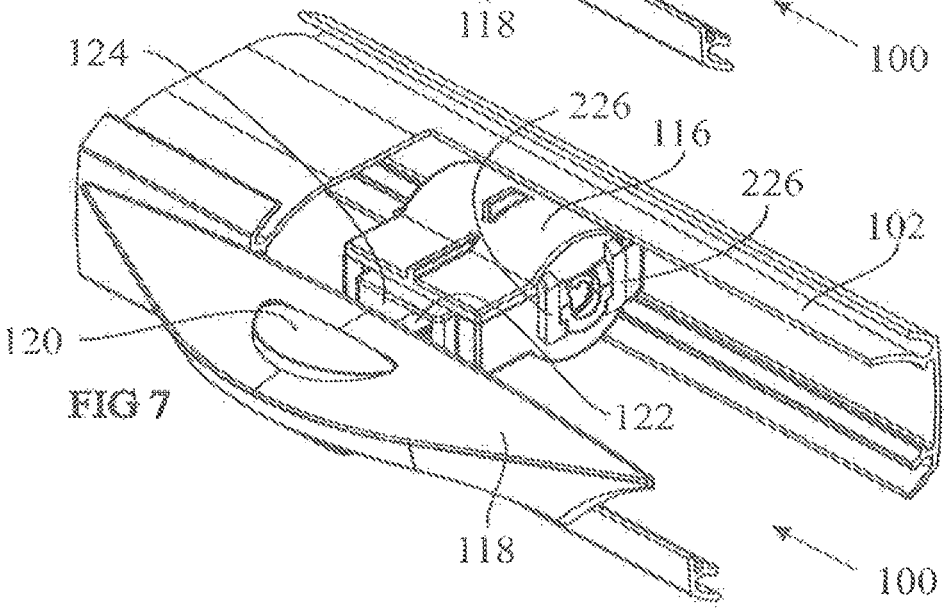

As shown in FIGS. 5-7, the brake 116 may be located anywhere along the axial length of the rail 102 as long as it is aligned approximately in the vicinity of the pusher 122, which in this embodiment is a shaft. As long as the pusher 122 abuts the contact plate 124 of the brake 116, the handle and brake combination 100 will operate as designed.

Figure 9:
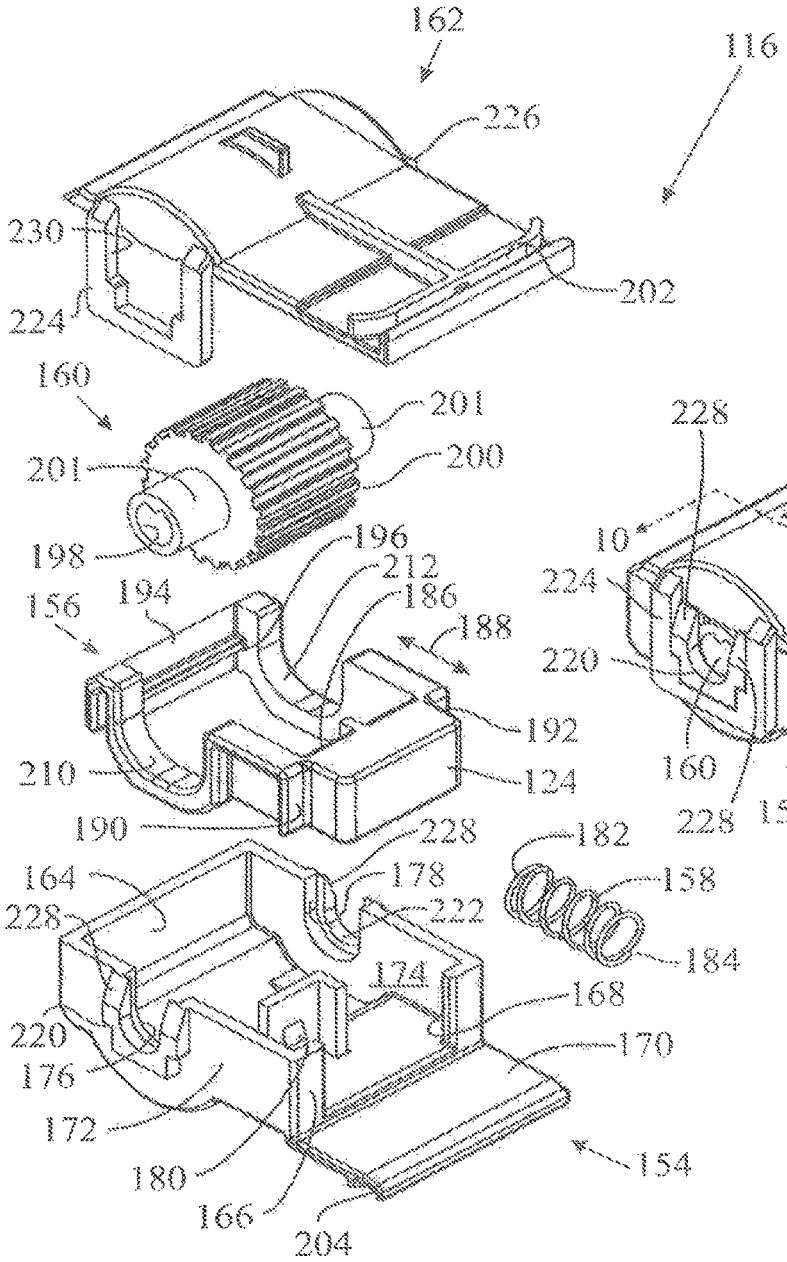
FIG. 9 is an exploded perspective view of the brake portion of FIG. 8.

FIG. 9 shows the details of the brake 116. The brake 116 includes a housing base 154, a slide element 156, a coil spring 158, a splined sleeve 160 and a housing cover 162. The housing base 154 is a substantially rectangular box having a flat back wall 164, a flat front wall 166 which defines a large central opening 168, and a forwardly extending fixed tab 170 secured to the front wall 166 for mounting the housing base 154 on the rail 102. The housing base 154 includes side walls 172, 174, which define aligned, "U"-shaped openings 176, 178 which provide bearing surfaces to rotationally support the splined sleeve 160. The housing base 154 also defines an internal projection 180 designed to receive and engage one end 182 of the coil spring 158. The other end 184 of the coil spring 158 is received in a partitioned cavity 186 on the slide element 156, in order to bias the slide element 156 in the forward (braking) direction, which is transverse to the axis of rotation of the lift rod 112, as will be described in more detail later.

The slide element 156 has a contact plate 124, which is pushed against by the actuator in the handle 118, in a direction opposite to the braking direction, in order to disengage the brake. The slide element 156 is received in the housing base 154, with the contact plate 124 of the slide element 156 projecting through the opening 168 in the housing 154. The slide element 156 is guided by the housing base 154 so its movement is restricted to forward and backward movement in the direction of the arrow 188 relative to the housing base 154. Shoulders 190, 192 on the slide element 156 limit the movement of the slide element 156 in the forward direction as they impact the front wall 166 of the housing 154. As indicated above, the coil spring 158 biases the slide element 156 in the forward direction (which as explained later, is the braked position). The rear wall 194 of the slide element 156 defines a left-to-right directed ridge 196, which extends parallel to the front and rear walls 124, 194 of the slide element 156 and parallel to the lift rod 112.

The splined sleeve 160 is a generally cylindrical body defining a hollow through shaft 198 having a non-circular profile. In this particular embodiment, the hollow through shaft 198 has a "V" projection profile. The lift rod 112 (See FIG. 2) has a complementary "V" notch. The lift rod 112 is sized to match the internal profile of the hollow through shaft 198, with the "V" projection of the hollow through shaft 198 being received in the "V" notch of the lift rod 112, such that the splined sleeve 160 and the lift rod 112 are positively engaged to rotate together. Thus, when the splined sleeve 160 is prevented from rotation, the lift rod 112 is likewise prevented from rotation.

The splined sleeve 160 also defines a plurality of radially extending splines 200. The ends of the splined sleeve 160 define smooth stub shafts 201 which are rotationally supported on the "U"-shaped bearing surfaces 176, 178 of the housing base 154. The slide element 156 has recessed arms 210, 212, which permit the slide element 156 to move forwardly and backwardly within the housing base 154 without interfering with the stub shafts 201.

Figure 10:
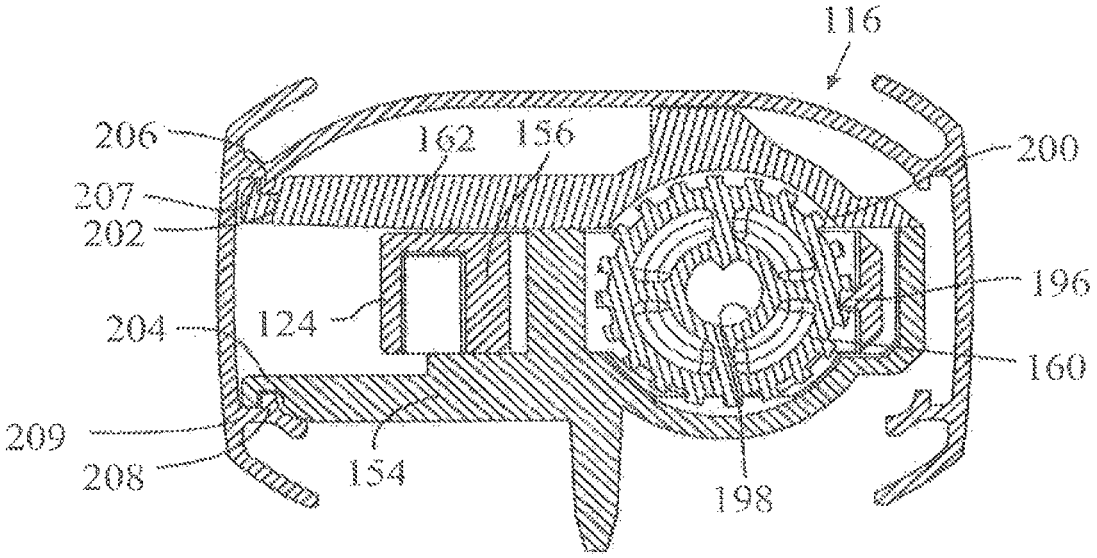
FIG. 10 is a section view along line 10-10 of FIG. 8.
Figure 11:
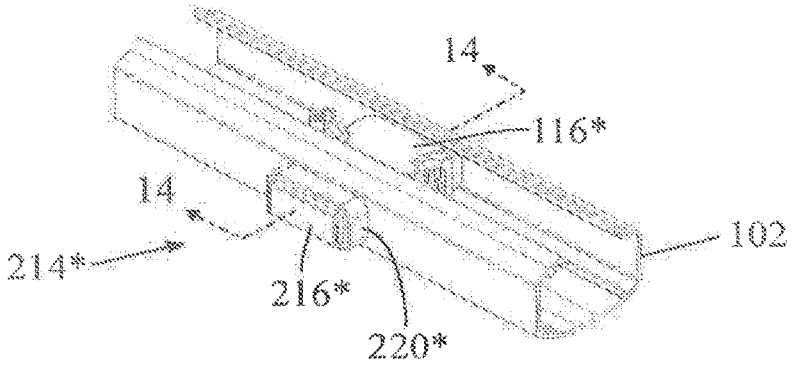
FIG. 11 is a perspective view of a brake, similar to the brake of FIG. 8, but with a surface mounted button actuator instead of the handle of FIGS. 5-7, and showing a broken-away view of the rail.
Figure 12:
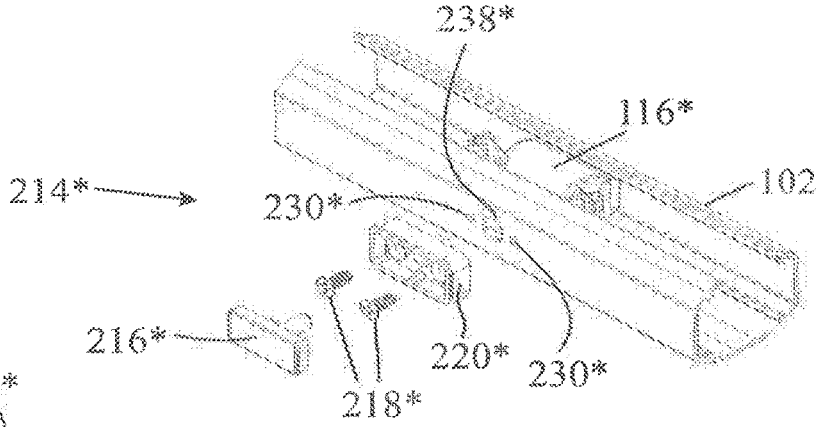
FIG. 12 is a partially exploded perspective view of the brake and button arrangement of FIG. 11.
Figure 13:
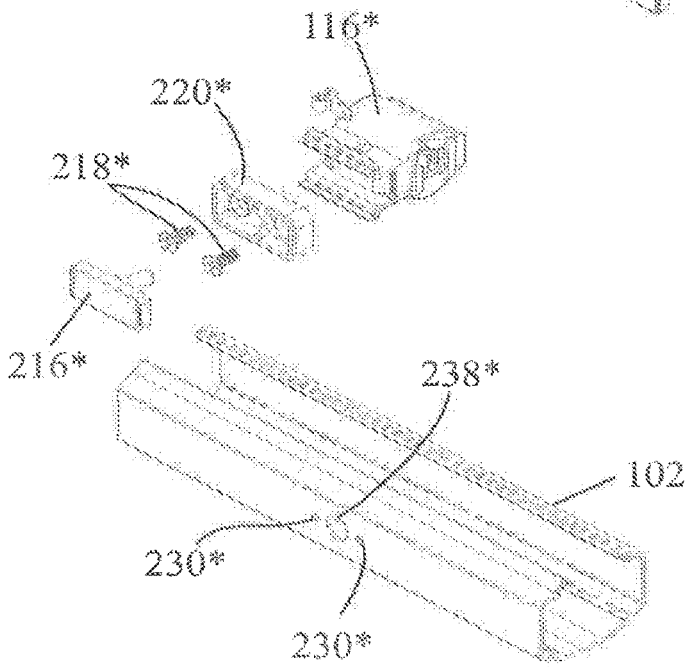
FIG. 13 is a further exploded perspective view of the brake and button arrangement of FIG. 12.

As shown in FIG. 10, when the slide element 156 is pushed forward by the biasing spring 158, which is its normal, braked position, the ridge 196 on the rear wall 194 of the slide element 156 is received between two of the splines 200 of the splined sleeve 160, which prevents rotation of the splined sleeve 160 and of the lift rod 112 (and of the lift drums in the lift stations 110), thereby preventing the movable rail 102 from being raised or lowered.

When the slide element 156 is pushed rearwardly by pushing against the contact plate 124, the ridge 196 moves out of engagement with the splined sleeve 160, allowing the splined sleeve 160, the lift rod 112, and the lift drums to rotate in order to raise or lower the movable rail 102.

A housing cover 162 snaps onto the housing base 154 to substantially enclose the slide element 156 and the coil spring 158, as well as the splined sleeve 160 within the housing of the brake 116. As shown in FIG. 10, a channel 202 on the housing cover 162 and a corresponding channel 204 on the housing base 154 receive corresponding lips 206, 208 on the rail 102, and ribs 207, 209 on the housing cover 162 and housing base 154 engage the lips 206, 208 on the rail 102 (See FIG. 10) to mount the brake 116 onto the rail 102. This mounting arrangement for the cover 162 and base 154 of the brake 116 firmly secures the body of the brake 116 to the front wall of the rail 102 while allowing the brake 116 to slide in the longitudinal direction along the rail 102.

Rail-Mounted Button Actuator

As discussed earlier, FIGS. 1-7 show a brake 116 mounted onto a movable rail 102 wherein an actuator button 120 on the handle 118 actuates a pusher 122 which impacts against a contact plate 124 to disengage the brake 116, allowing the rail 102 to be raised or lowered by the user. FIGS. 11-16 show an alternative embodiment of an actuator button 216*, with a surface-mounted button arrangement 214*, in which the rail 102 itself acts as a handle, wherein the user, as he grabs the rail 102, pushes on the actuator button 216* to disengage the brake 116*, allowing him to raise or lower the rail 102. As the user releases the rail 102, he also releases the button 216*, which then allows the brake 116* to re-engage to prevent further movement of the rail 102.

FIGS. 17-22 show a similar embodiment, but for a recess-mounted button arrangement 214 for disengaging the brake 116***. It should be noted that in both embodiments the screws securing the button housings to the rail are hidden from view from the exterior of the rail by the actuator buttons.

Figure 8:
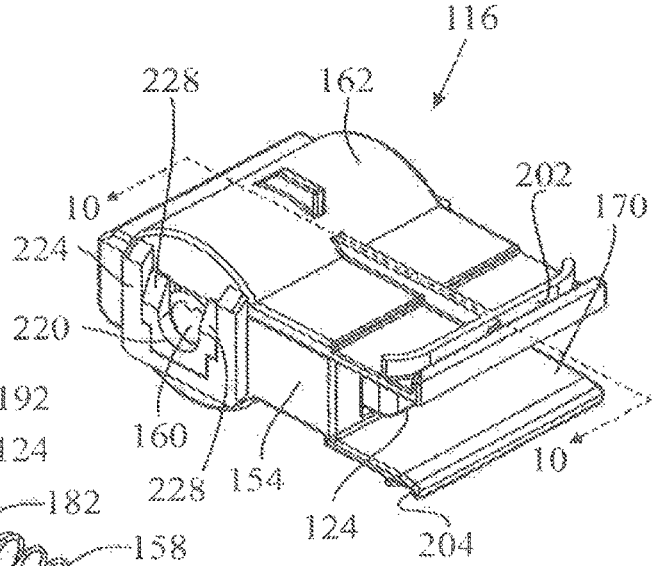
FIG. 8 is a perspective view of the brake portion of the brake and handle mechanism of FIG. 7.

Referring now to FIGS. 11-14, the surface-mount button arrangement 214* includes an actuator button 216*, two fasteners 218*, which in this embodiment are screws, a button housing 220*, and a brake 116*, all mounted to the rail 102. The brake 116* is similar to the brake 116 of FIGS. 8 and 9, including the contact plate 124* (See FIG. 14) and the mounting tabs 202*, 204* which allow the brake 116* to be affixed to the rail 102, preferably by sliding the brake 116* in from one end of the rail 102. As was described earlier with respect to the handle 118 with button 120 (See FIGS. 5-7), the exact location of the brake 116* with respect to the actuator button 216* is not critical as long as the pusher 122* of the actuator button 216* makes contact with the contact plate 124*.

Figure 15:
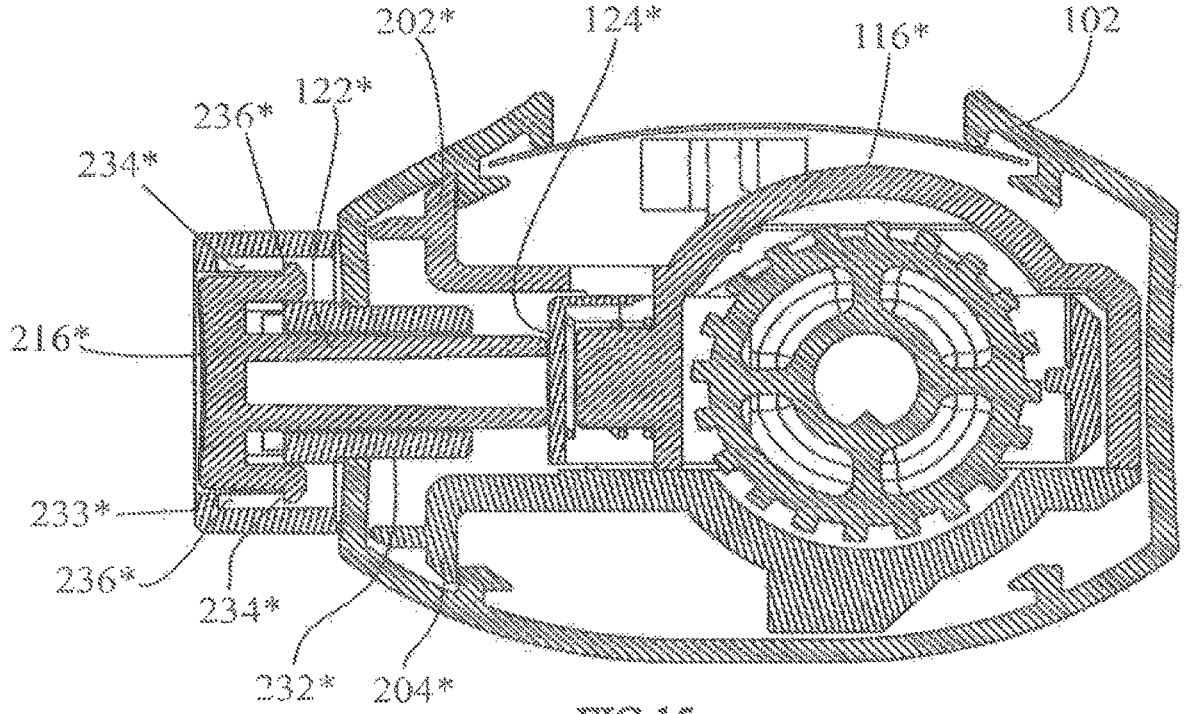
FIG. 15 the same as FIG. 14 but with the button in the depressed position.
Figure 16:
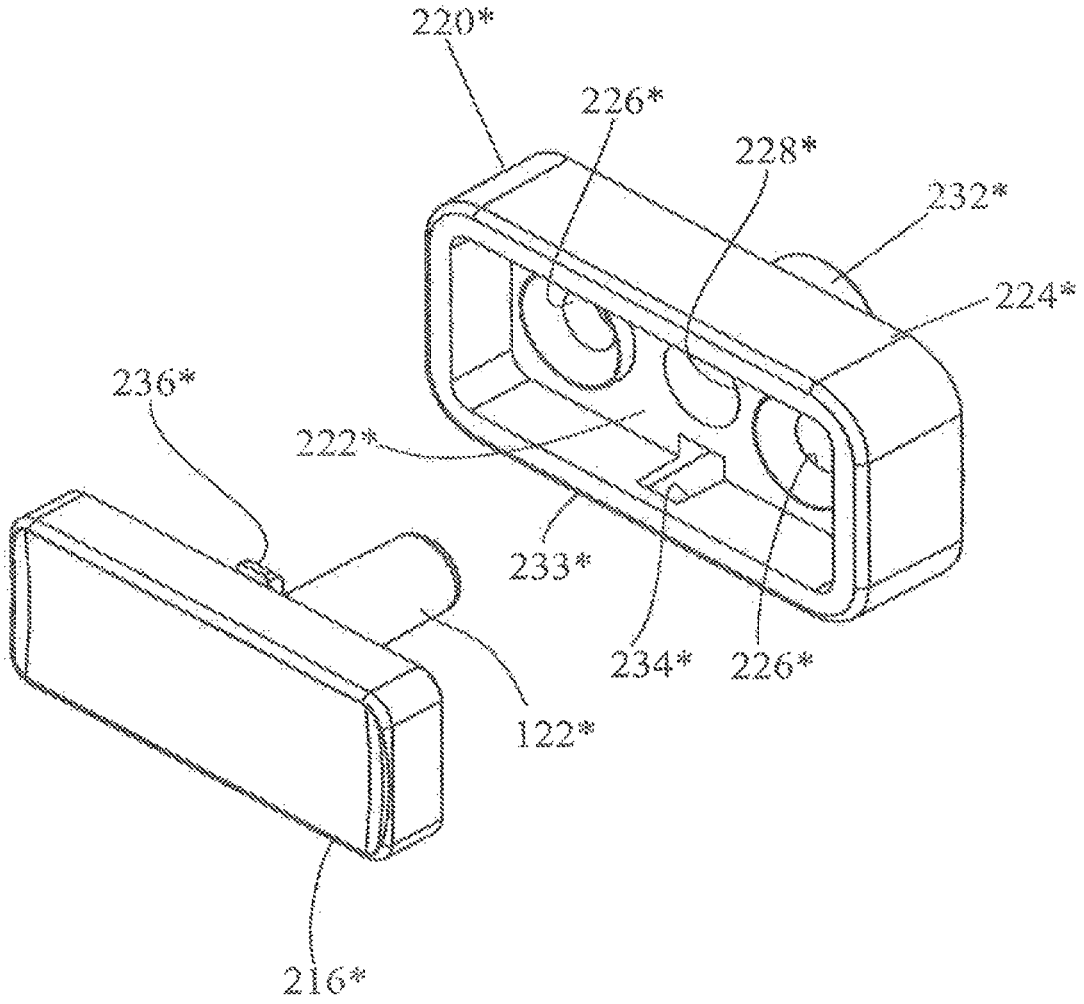
FIG. 16 is an enlarged perspective view of the housing and button of FIG. 12.
Figure 17:
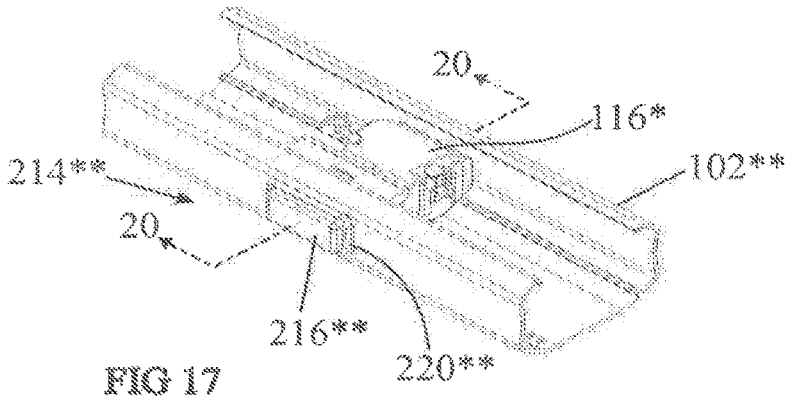
FIG. 17 is a partially broken-away, perspective view of a rail and brake, similar to the brake of FIG. 11, but with a recess-mounted button actuator.
Figure 18:
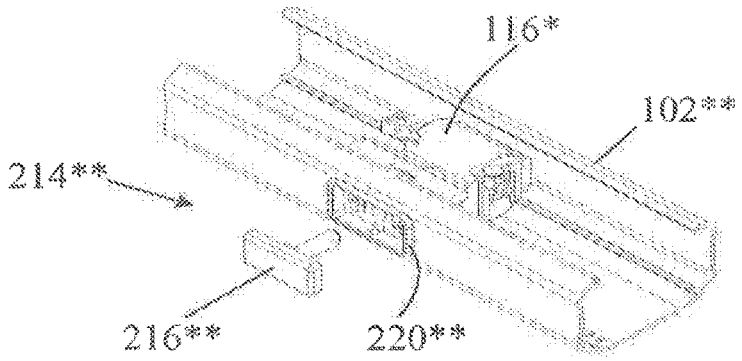
FIG. 18 is a partially exploded perspective view of the brake and button arrangement of FIG. 17.
Figure 19:
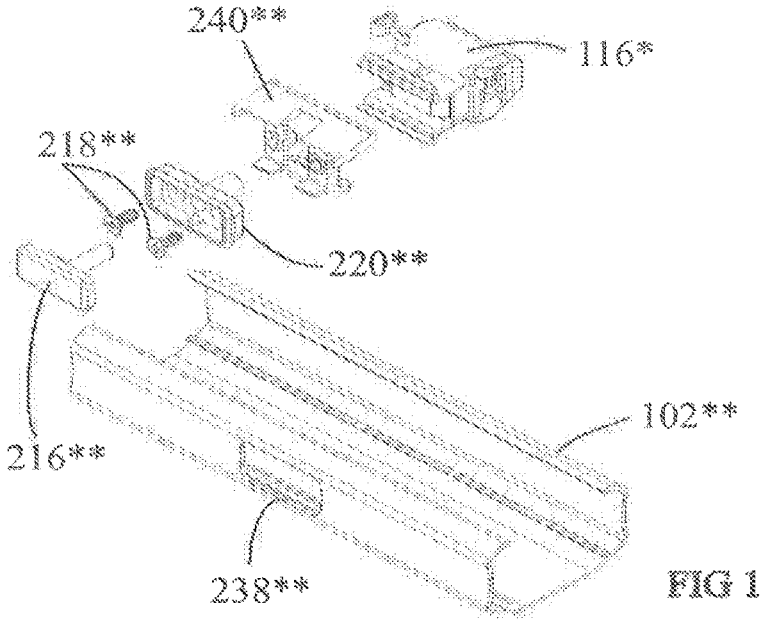
FIG. 19 is a further exploded perspective view of the brake and button arrangement of FIG. 18.
Figure 20:
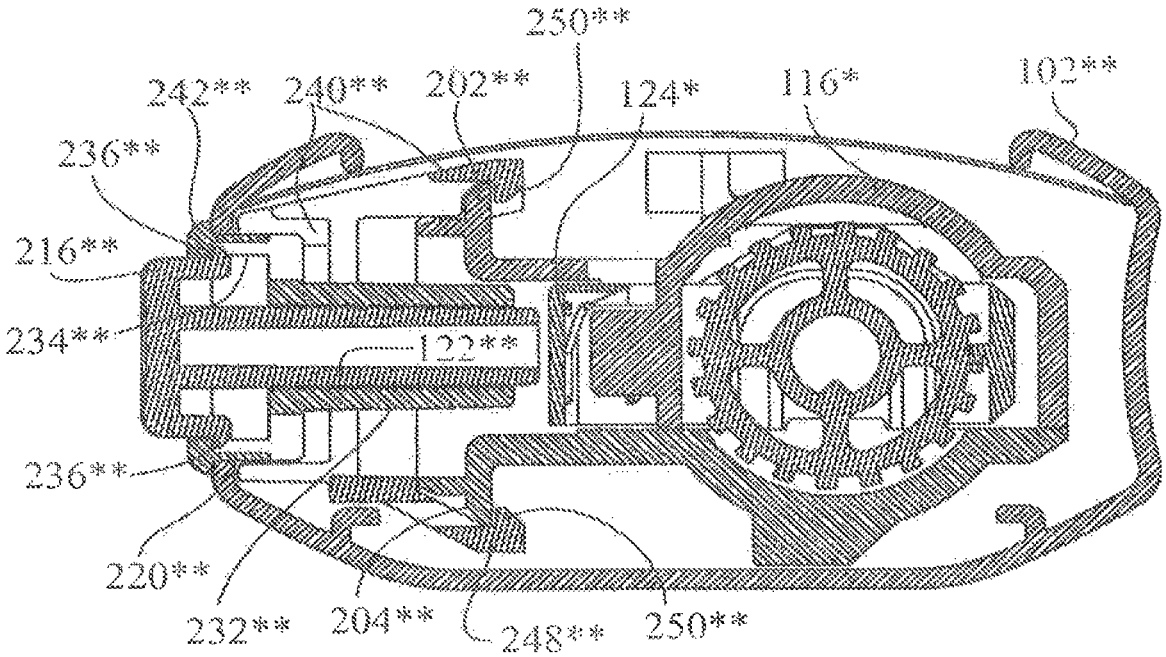
FIG. 20 is a section view along line 20-20 of FIG. 17.
Figure 21:
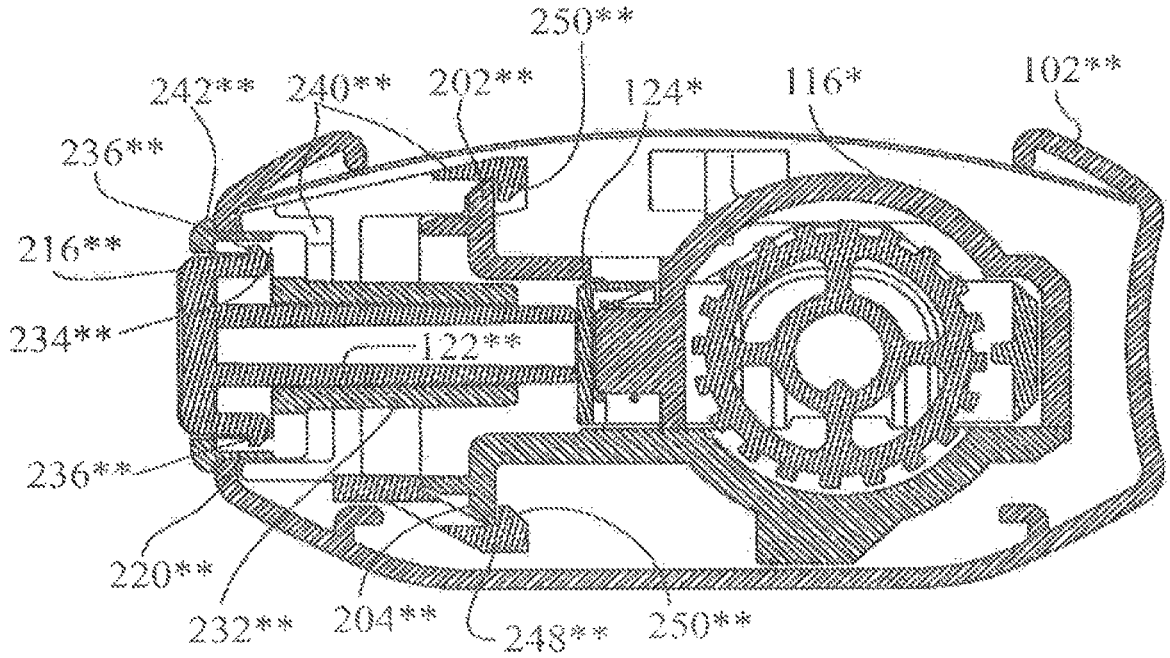
FIG. 21 is the same as FIG. 20 but with the button depressed.

Referring to FIG. 16, the button housing 220* is a four-sided box 224* which is open to the front (to receive the button 216*) and has a wall 222* closing off the rear of the box 224*. The rear wall 222* defines two through openings 226* for receiving the screws 218* and one through opening 228* for receiving the pusher 122* on the rear of the actuator button 216*. The openings 226* align with corresponding openings 230* on the rail 102 so that the housing 220* is releasably secured to the rail 102 using the fasteners 218* (as shown also on FIGS. 12 and 13). The pusher opening 228* is defined by a hollow shaft 232* which projects from the rear wall 222* of the button housing 220*. This hollow shaft 232* guides and supports the pusher 122* which projects from the back of the button 216. The front of the box 224* includes a frame 233*, which defines the front end of two opposed, upper and lower parallel, slots 234* (See FIGS. 14-16). These slots 234* receive respective barbed, hook projections 236* on the actuator button 216* to allow restricted, linear, in-and-out motion of the actuator button 216* relative to the rail 102 and housing 220* as the projections 236* ride linearly in the tracks formed by the slots 234* so that the pusher 122* may push inwardly against the contact plate 124* of the brake 116* to disengage the brake 116*. The frame 233*, defining the front of the slots 234*, locks the actuator button 216* inside the box 224* of the housing 220* relative to the housing 220*

It should be noted that the barbed, hook projections 236* have a ramped rear surface facing inwardly, toward the brake 116* and a flat, vertical front face which abuts the vertical face of the frame 233* at the front end of the slot 234* when the actuator button is in its forwardmost position. The ramped rear surface helps assemble the button 216* onto the housing 220*, helping the projections 236* flex as they contact the frame 233* at the front of the housing 220* until they get into the slots 234*, at which point they return to their original shape, with the vertical front face of each projection 236* abutting the vertical face of the frame 233* at the front of the slot 234*, to retain the button 216* on the housing 220*. Once the actuator button 216* is installed in the housing 220*, the actuator button 216* conceals the screw fasteners 218* so that the screw fasteners 218* are not visible from the exterior of the rail 102.

Assembly

Figure 14:
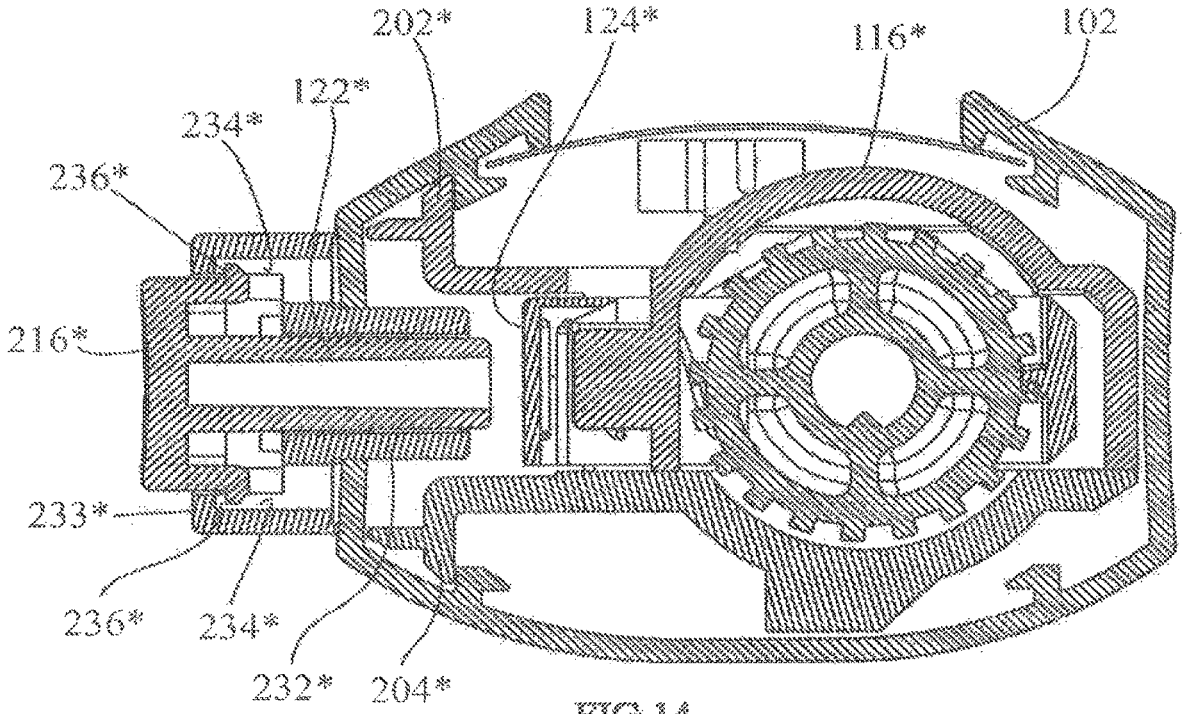
FIG. 14 is a section view along line 14-14 of FIG. 11.

To assemble the surface-mount actuator button arrangement 214*, the button housing 220* is mounted to the rail 102 using the screw-type fasteners 218*, which extend through the openings 226* on the housing 220* and are threaded into the openings 230* in the rail 102. The actuator button 216* is then snapped into the box 224* of the housing 220*. The ramped rear surfaces of the barbed projections 236* push against the forward frame 233*, causing the projections 236* to momentarily deflect until the projections 236* pass through the frame 233* and reach the slots 234*, where the projections 236* spring back out to lock the actuator button 216* in the housing 220*, while still allowing the actuator button 216* to move linearly in a front-to-rear direction within the housing 220*, with the projections 236* moving in and out along the tracks formed by the slots 234* as shown in FIGS. 14 and 15. The pusher 122* extends through the opening 228* of the hollow shaft 232* of the housing 220* and projects out the back of the hollow shaft 232*. The brake 116* is then installed by sliding it into position along the length of the rail 102 until it is generally in the area of the button 216* such that pressing the button 216* results in the pusher 122* pushing inwardly against the contact plate 124* of the brake 116* so as to disengage the brake 116*.

Alternative Rail-Mounted Button Actuator

Referring now to FIGS. 17-22, the button arrangement 214 is recess-mounted on the rail 201. The rail 102 is wider than the rail 102, which provides enough room to recess the actuator button into the rail. Otherwise, the button of FIGS. 17-22** functions in the same manner as the previous embodiment.

The recess-mount actuator button arrangement 214 includes an actuator button 216., two screw fasteners 218., a button housing 220., a button housing adapter 240., and a brake 116*, all mounted to the rail 102.. The brake 116* is identical to the brake 116* described above for the surface-mount button arrangement 214*.

Figure 22:
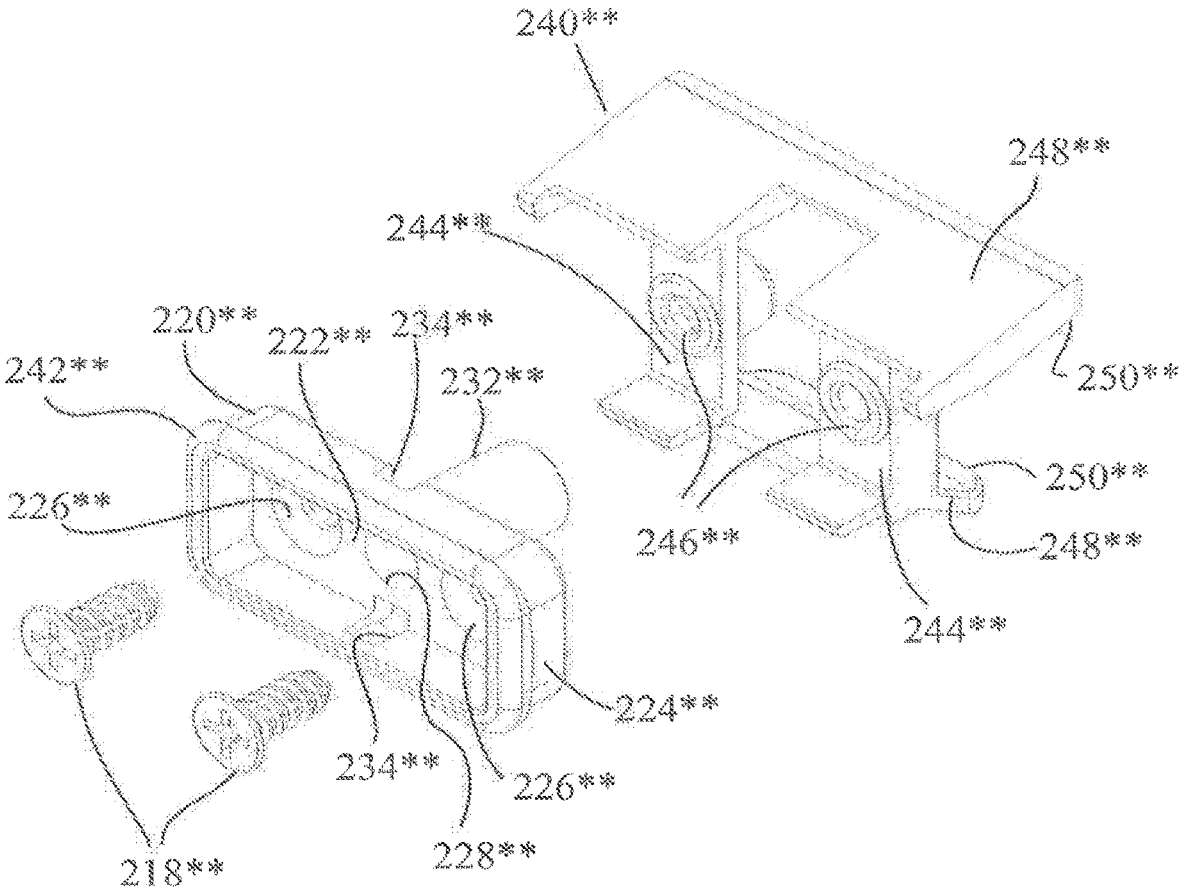
FIG. 22 is an enlarged perspective view of the housing and housing adapter of FIG. 19.

Referring to FIG. 22, the housing 220. is very similar to the housing 220*, described earlier with respect to the surface-mount button arrangement 214*. However, in this embodiment, the frame 242. at the front of the box 224. is a flange, with a rear surface abutting the rail 102. at the single large opening 238. (See FIG. 19) such that the housing 220. itself is recessed into the rail 102. with only the flanged frame 242. projecting outside of the rail 102. and mounted flush against the rail 102..

The housing adapter 240. is located inside the rail 102. and includes two vertical walls 244., each defining an internally threaded opening 246., which receive the two screw fasteners 218. after the screw fasteners 218. extend through the openings 226. in the button housing 220. so as to secure both the button housing adapter 240. and the button housing 220. to the rail 102., with the front wall of the rail 102. trapped between the button housing adapter 240. and the flanged frame 242. of the button housing 220.. The button housing adapter 240. defines two rearwardly-directed wings 248., with each wing 248. defining a distal-end lip 250. (See also FIG. 20) to slidably engage the mounting tabs 202*, 204* on the brake 116***.

As was the case for the button housing 220*, the button housing 220. is a four-sided box 224. which is open to the front (to receive the button 216.) and has a wall 222. closing off the rear of the box 224.. The rear wall 222. defines two through openings 226. for receiving the screw fasteners 218. and a central opening 228. for receiving the pusher 122.. The screw openings 226. align with the corresponding openings 246. on the button housing adapter 240. so that the housing 220. may be releasably secured to the button housing adapter 240. using the screw fasteners 218.. The central opening 228. is defined by a hollow shaft 232. which projects from the rear wall 222. of the housing 220.. This hollow shaft 232. guides and supports the pusher 122. which projects from the back of the actuator button 216.. The box 224. also defines upper and lower slots 234. which receive corresponding barbed, hook projections 236. on the button 216. to lock the button 216. inside the box 224. of the housing 220. and to allow restricted, linear, in-and-out motion of the button 216. relative to the housing 220. as projections 236. ride in the track formed by the slots 234. so that the pusher 122. can push against the contact plate 124* of the brake 116* to disengage the brake 116***.

Assembly

To assemble the recess-mount button arrangement 214., the housing 220. is mounted to the rail 102. using the screw fasteners 218. going through the openings 226. on the housing 220. and threading into the openings 246. in the button housing adapter 240., with the front wall of the rail 102. trapped between the flanged frame 242. of the housing 220 and the front edge of the housing adapter 240.. The actuator button 216. is then snapped into the box 224. of the housing 220.. The barbed projections 236. momentarily deflect as they pass by the flanged frame 242., until the projections 236. reach the slots 234. where the projections 236. spring back out to lock the button 216. in the housing 220., restricting the button 216. to linear movement along the tracks formed by the slots 234.. The pusher 122. of the button 216. fits through the opening 228. of the hollow shaft 232. of the housing 220. and projects rearwardly. The brake 116* is then installed by sliding it into position along the length of the rail 102. until it is generally in the area of the button 216. such that pressing the button 216. results in the pusher 122** pushing against the contact plate 124* of the brake 116* so as to disengage the brake 116*. Once the actuator button 216** is installed onto the housing 220**, the actuator button 216** conceals the screw fasteners 218** so they cannot be seen from the exterior of the rail 102****.

While, in the embodiments described above, the actuator button is used to actuate a brake, it is understood that the same actuator button mounting arrangement could be used for an actuator button to actuate a different function on the window covering, if desired.

It will be obvious to those skilled in the art that modifications may be made to the embodiments described above without departing from the scope of the present invention as claimed.

What is claimed is:

1. A brake arrangement for a covering for an architectural opening, the arrangement comprising:

a hollow rail defining an exterior front face and an interior;

a rod extending within said interior of said hollow rail and being rotatable about an axis of rotation;

a brake provided in operative association with said rod, said brake configured to be selectively disengaged from said rod to allow said rod to rotate about said axis of rotation;

an actuator button supported relative to said hollow rail along said exterior front face of said hollow rail, said actuator button being configured for movement relative to said exterior front face of said hollow rail in an actuation direction extending toward and away from said axis of rotation of said rod;

a pusher rod extending within said hollow rail and provided in operative association with said actuator button, said pusher rod being configured for movement relative to said brake;

wherein, when said actuator button is moved in the actuation direction, said pusher rod actuates said brake relative to said rod to disengage said brake from said rod.

2. The brake arrangement of claim 1, wherein said pusher rod is configured for movement with said actuator button in the actuation direction when said actuator button is moved in the actuation direction.

3. The brake arrangement of claim 1, wherein said pusher rod is formed integrally with or rigidly coupled to said actuator button.

4. The brake arrangement of claim 1, wherein said pusher rod extends from a back side of said actuator button.

5. The brake arrangement of claim 1, wherein the actuation direction extends perpendicular to said axis of rotation of said rod.

6. The brake arrangement of claim 1, wherein:

said exterior front face of said hollow rail corresponds to a substantially planar face of said hollow rail; and said substantially planar face extends perpendicular to the actuation direction of said actuator button.

7. The brake arrangement of claim 1, wherein a movable portion of said brake is configured to be moved relative to said rod to selectively disengage said brake from said rod.

8. The brake arrangement of claim 7, wherein:

when said pusher rod is moved in the actuation direction with said actuator button, said pusher rod contacts said movable portion of said brake; and said pusher rod is configured to actuate said movable portion of said brake in the actuation direction.

9. The brake arrangement of claim 7, wherein:

said movable portion of said brake is biased towards a braking position at which said brake engages said rod to prevent rotation of said rod about said axis of rotation; and when said actuator button is released following movement of said actuator button in the actuation direction, said actuator button moves away from said rod as said movable portion of said brake is biased towards said braking position.

10. The brake arrangement of claim 7, wherein said pusher rod is configured for movement relative to said movable portion of said brake.

11. The brake arrangement of claim 1, further comprising a button housing coupled to said hollow rail such that said button housing is positioned at least partially at said exterior front face of said hollow rail, said actuator button being received within said button housing along said exterior front face of said hollow rail.

12. The brake arrangement of claim 11, wherein:

said button housing defines a button cavity configured to receive said actuator button; and said actuator button is movable relative to said button housing within said button cavity along the actuation direction.

13. The brake arrangement of claim 11, wherein said button housing is mounted to said hollow rail such that at least a portion of said button housing is recessed relative to said exterior front face of said hollow rail.

14. The brake arrangement of claim 11, wherein:

said button housing defines a button cavity extending in the actuation direction between an open end and an opposed wall; and said button housing is mounted to said exterior front face of said hollow rail such that said wall is positioned directly adjacent to said exterior front face.

15. The brake arrangement of claim 14, wherein said button housing is mounted to said hollow rail via at least one fastener extending through both said wall of said housing and said exterior front face.

16. The brake arrangement of claim 11, wherein a portion of said button housing extends through said exterior front face and is received within said interior of said hollow rail.

17. The brake arrangement of claim 16, wherein said portion of said button housing defines a hollow shaft for supporting said pusher rod for movement in the actuation direction.

18. A brake arrangement for a covering for an architectural opening, said brake arrangement comprising:

a hollow rail defining an exterior front face and a substantially hollow interior;

a rod extending within said interior of said hollow rail and operative to cause said covering to extend or to retract;

a brake configured and arranged to prevent or allow movement of said covering; and an actuator button formed separately from said brake and supported relative to said rail, said actuator button configured for movement relative to said rail in a direction toward and away from said rod to actuate said brake;

wherein said brake is separately supported within said rail for movement relative to said actuator button along an axial direction of said rod when installing said brake relative to said actuator button.

19. The brake arrangement of claim 18, wherein said brake is provided for movement into and out of engagement with said rod to actuate said brake to prevent or allow movement of said covering, respectively.

20. The brake arrangement of claim 18, wherein said brake engages said rod to prevent both rotation of said rod and extension or retraction of said covering.

21. The brake arrangement of claim 18, wherein said actuator button is configured for movement relative to said rail in a direction perpendicular to the axial direction of said rod.

22. The brake arrangement of claim 18, further comprising a pusher rod extending within said hollow rail, said pusher rod being configured for movement with said actuator button relative to said brake when said actuator button is moved in said direction towards said rail.

23. The brake arrangement of claim 22, wherein:

when said pusher rod is moved in the direction towards said rail with said actuator button, said pusher rod contacts a movable portion of said brake; and said pusher rod is configured to actuate said movable portion of said brake to cause said brake to be disengaged from said rod.

24. A brake arrangement for a covering for an architectural opening, said brake arrangement comprising:

a hollow rail defining an exterior front face and a substantially hollow interior;

a rod extending within said interior of said hollow rail and operative to cause said covering to extend or to retract;

a brake comprising an engagement portion oriented towards said rod and configured for movement into and out of engagement with said rod to actuate said brake to prevent or allow movement of said covering, respectively; and an actuator button supported relative to said exterior front face of said rail and formed separately from said brake, said actuator button supported for movement toward and away from said brake to actuate said brake.

25. The brake arrangement of claim 24, wherein said actuator button is configured for movement relative to said brake in a direction perpendicular to an axis of rotation of said rod.

26. The brake arrangement of claim 24, wherein:

said exterior front face of said hollow rail corresponds to a substantially planar face of said hollow rail; and said substantially planar face extends perpendicular to a direction of movement of said actuator button toward and away from said brake.

27. The brake arrangement of claim 24, wherein said hollow rail acts as a handle such that said rail is grasped when moving said actuator button towards said brake.

28. The brake arrangement of claim 24, further comprising a pusher rod extending within said hollow rail, said pusher rod being configured for movement with said actuator button when said actuator button is moved towards said brake.

29. The brake arrangement of claim 28, wherein:

when said pusher rod is moved in a direction towards said brake with said actuator button, said pusher rod contacts a movable portion of said brake; and said pusher rod is configured to actuate said movable portion of said brake to cause said brake to be disengaged from said rod.

30. The brake arrangement of claim 28, wherein:

said engagement portion of said brake extends towards said rod in an actuation direction; and said engagement portion is configured for movement towards and away from said rod in the actuation direction.

* * * * *